US010928166B2

(12) United States Patent
Brennan et al.

(10) Patent No.: US 10,928,166 B2
(45) Date of Patent: Feb. 23, 2021

(54) BULLET-PROOF LOCKDOWN SYSTEM

(71) Applicants: Christine M. Szudy Brennan, Parma, OH (US); Sean James Brennan, Parma, OH (US)

(72) Inventors: Christine M. Szudy Brennan, Parma, OH (US); Sean James Brennan, Parma, OH (US)

( * ) Notice: Subject to any disclaimer, the term of this patent is extended or adjusted under 35 U.S.C. 154(b) by 0 days.

(21) Appl. No.: 16/457,079

(22) Filed: Jun. 28, 2019

(65) Prior Publication Data

US 2020/0003528 A1 Jan. 2, 2020

Related U.S. Application Data

(60) Provisional application No. 62/691,645, filed on Jun. 29, 2018.

(51) Int. Cl.

| | |
|---|---|
| ***F41H 5/24*** | (2006.01) |
| ***F41H 5/013*** | (2006.01) |
| ***E05F 15/60*** | (2015.01) |
| ***E06B 5/10*** | (2006.01) |

(52) U.S. Cl.

CPC ..... *F41H 5/24* (2013.01); *E05F 15/60* (2015.01); *E06B 5/10* (2013.01); *F41H 5/013* (2013.01); *E05Y 2900/148* (2013.01)

(58) Field of Classification Search

CPC ..... F41H 5/24; E06B 5/12; E06B 5/10; E05G 1/026

USPC ..... 89/36.04, 36.01; 109/49.5

See application file for complete search history.

(56) References Cited

U.S. PATENT DOCUMENTS

| | | | | |
|---|---|---|---|---|
| 3,516,470 | A * | 6/1970 | Kurz | E06B 9/0669 160/35 |
| 5,472,037 | A * | 12/1995 | Hoffman | E05D 7/009 160/118 |
| 5,595,233 | A * | 1/1997 | Gower | E06B 9/00 160/183 |
| 5,924,468 | A * | 7/1999 | Bisconti | E06B 9/0669 160/117 |
| 6,286,579 | B1 * | 9/2001 | Gottschalk | E06B 9/42 160/183 |
| 8,281,841 | B2 * | 10/2012 | Landry | E06B 5/003 160/62 |
| 9,243,445 | B2 * | 1/2016 | Beaudoin | E06B 7/28 |

(Continued)

FOREIGN PATENT DOCUMENTS

WO 2018048940 3/2018

*Primary Examiner* — Reginald S Tillman, Jr.

(74) *Attorney, Agent, or Firm* — Renner, Otto, Boisselle & Sklar, LLP

(57) ABSTRACT

A lockdown barrier system and method includes a first mount that is secured to a wall surface and a sheet of shielding material formed of an anti-ballistic material that is moveable between a retracted position and an extended position. The sheet of shielding material has a first end that is secured to the first mount and a second end opposite the first end that is freely moveable away from the first mount. The system includes a second mount that is secured to the wall surface at a location that is spaced from the first mount. The second end of the sheet of shielding material is releasably connectable to the second mount and is secured proximate to the first mount when in the retracted position. The second end is secured to the second mount when in the extended position.

18 Claims, 6 Drawing Sheets

(56) References Cited

U.S. PATENT DOCUMENTS

| | | | | |
|---|---|---|---|---|
| 2002/0152881 | A1* | 10/2002 | Stevens | F41H 5/007 89/36.17 |
| 2006/0151132 | A1* | 7/2006 | Scalfani | E06B 9/08 160/268.1 |
| 2007/0204526 | A1* | 9/2007 | Davidson | E06B 9/0638 52/64 |
| 2008/0086952 | A1* | 4/2008 | Holwick | E04G 21/30 52/3 |
| 2009/0183447 | A1* | 7/2009 | Hay, III | E06B 9/02 52/202 |
| 2011/0048292 | A1* | 3/2011 | Zimmer, II | F41H 5/24 109/64 |
| 2011/0203451 | A1* | 8/2011 | Turpin | F41H 5/06 89/36.02 |
| 2012/0060436 | A1* | 3/2012 | Zimmer, II | F41H 5/22 52/202 |

* cited by examiner

BULLET-PROOF LOCKDOWN SYSTEM

FIELD OF INVENTION

The present invention relates to a lockdown barrier system for windows and doors that includes a retractable and bullet-proof cover.

BACKGROUND

Unfortunately, active shooter events have become more prevalent in modern-day society. The active shooter events often take place in buildings such as schools and other places of employment. During an active shooter event, people that are located in an interior room, such as a classroom or office, may be unable to leave the interior room due to the life-threatening circumstances occurring in a hallway or open area outside of the interior room. When confined in the interior room, conventional buildings may not be equipped to prevent bullet penetration through a window or door of the interior room. Thus, the people inside the interior room are at risk of being penetrated by a bullet. Moreover, the active shooter may try to enter the interior room by shooting at the door or window.

Prior attempts to prevent bullets entering an interior room have included replacing conventional windows with bullet-proof glass. However, replacing every window in a building with bullet-proof glass material may be burdensome and costly. Still another attempt includes providing individual bullet-proof shields. However, providing an adequate number of shields for the potential number of at-risk individuals may also be burdensome and costly.

SUMMARY OF INVENTION

The present invention is directed towards a lockdown barrier system that can be implemented quickly and easily during an emergency-type situation. The system includes a continuous sheet of anti-ballistic material, such as Kevlar®, that is normally in a storage or retracted position and mounted against the wall on one side of a window or a door. The retracted state of the sheet may include the sheet being folded or rolled and held in place against the wall using a fastening mechanism. During the emergency situation, the sheet of material is moved to an extended state in which the sheet of material is moved across the window or door to an opposing side of the window or door where the sheet of material is secured in place to a mount arranged at the opposing side, such that the sheet of anti-ballistic material completely covers the window or door. After the emergency situation has ended, the sheet of material can be released from the extended position and moved back into the retracted position. The barrier system is particularly advantageous over providing bullet-proof glass or individual shields since the system is easily implementable and adaptable in conventional buildings, readily useable at any time after being installed, and easily operable by different types of users.

According to an embodiment of the invention, a lockdown barrier system includes a first mount that is secured to a wall surface and a sheet of shielding material formed of an anti-ballistic material that is moveable between a retracted position and an extended position. The sheet of shielding material has a first end that is secured to the first mount and a second end opposite the first end that is freely moveable away from the first mount. The lockdown barrier system further includes a second mount that is secured to the wall surface at a location that is spaced from the first mount. The second end of the sheet of shielding material is releasably connectable to the second mount and is secured proximate to the first mount when in the retracted position. The second end is secured to the second mount when in the extended position.

According to another embodiment of the invention, a method of forming a lockdown barrier system includes providing a continuous sheet of shielding material that is formed of an anti-ballistic material, fixing a first end of the sheet of shielding material to a wall surface, fixing an attachment mechanism to the wall surface at a location that is spaced from the first end of the sheet of shielding material, and forming a complementary attachment mechanism on a second end of the sheet of shielding material. The second end of the sheet of shielding material is engageable with the attachment mechanism to be held in an extended position. The method further includes forming a retaining mechanism on the sheet of shielding material or proximate the first end of the sheet of shielding material, whereby the sheet of shielding material is held in a retracted position proximate the first end of the sheet of shielding material.

Other systems, devices, methods, features, and advantages of the present invention will be or become apparent to one having ordinary skill in the art upon examination of the following drawings and detailed description. It is intended that all such additional systems, methods, features, and advantages be included within this description, be within the scope of the present invention, and be protected by the accompanying claims.

DETAILED DESCRIPTION

Aspects of the present invention relate to a lockdown barrier system for use in an interior room of a building, such as in a classroom of a school or an office of a workplace. Many other types of buildings may also implement the lockdown barrier system described herein. For example, buildings that house government agencies or law enforcement, or buildings that are located in an area that is susceptible to active shootings are also suitable applications. The lockdown barrier system enables easy implementation in conventional buildings while also providing an effective barrier for windows, doors, or other spaces of vulnerability in an interior room of the building.

Figure 1:
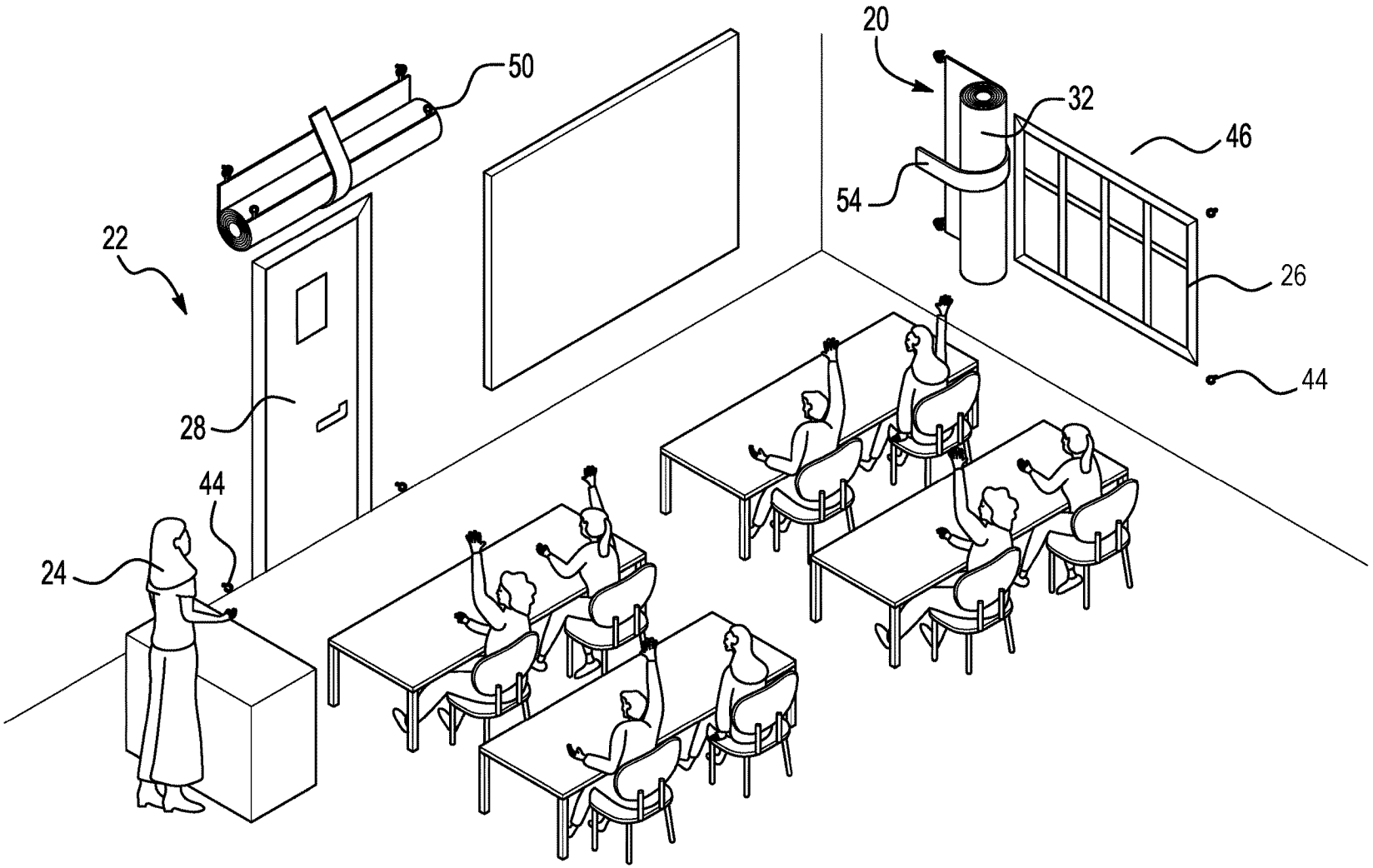
FIG. 1 is a schematic drawing of an interior room in a building that includes a lockdown barrier system in accordance with one embodiment of the present invention.
Figure 2:
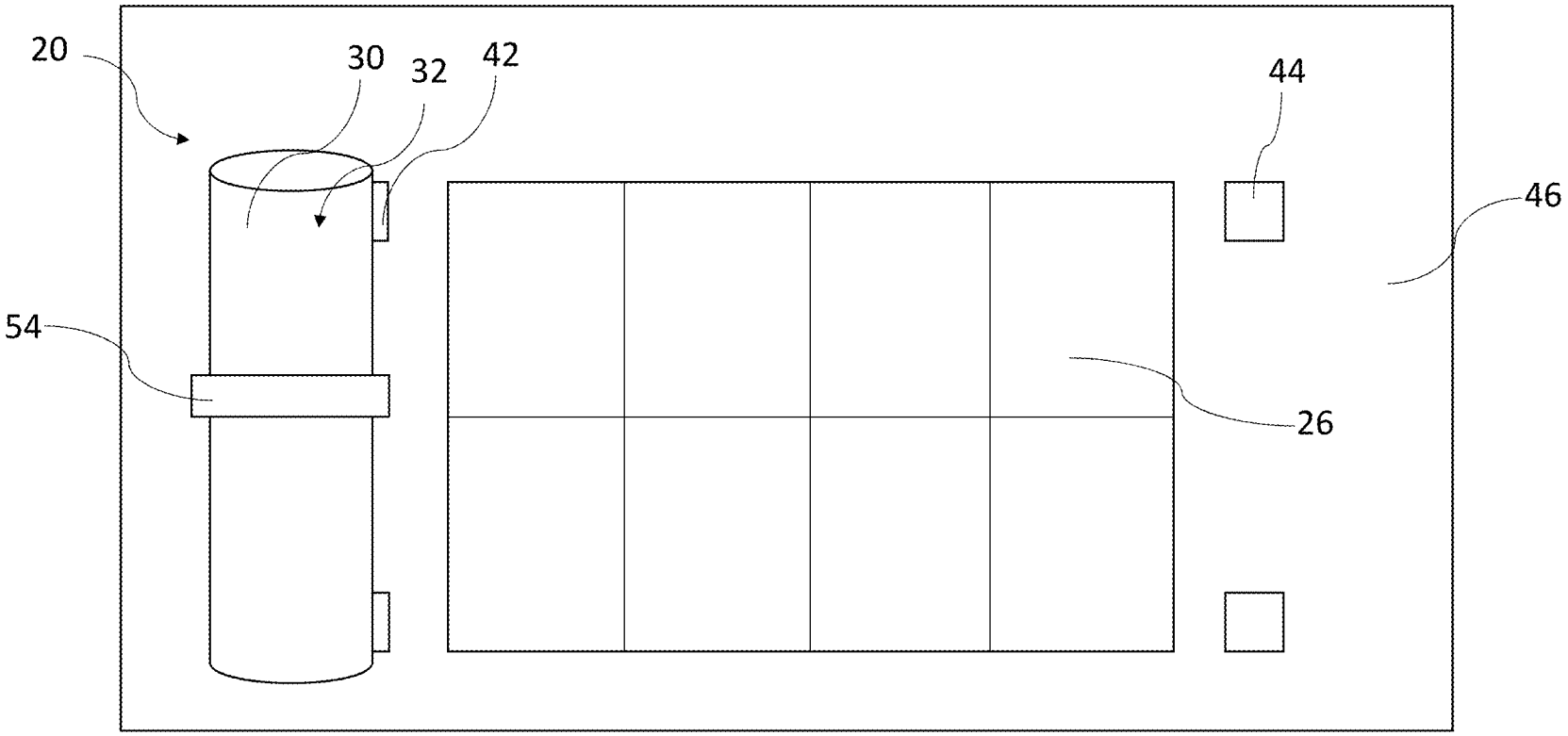
FIG. 2 is a schematic drawing of the lockdown barrier system of FIG. 1 showing an extendable sheet of anti-ballistic material being held in a retracted position.
Figure 3:
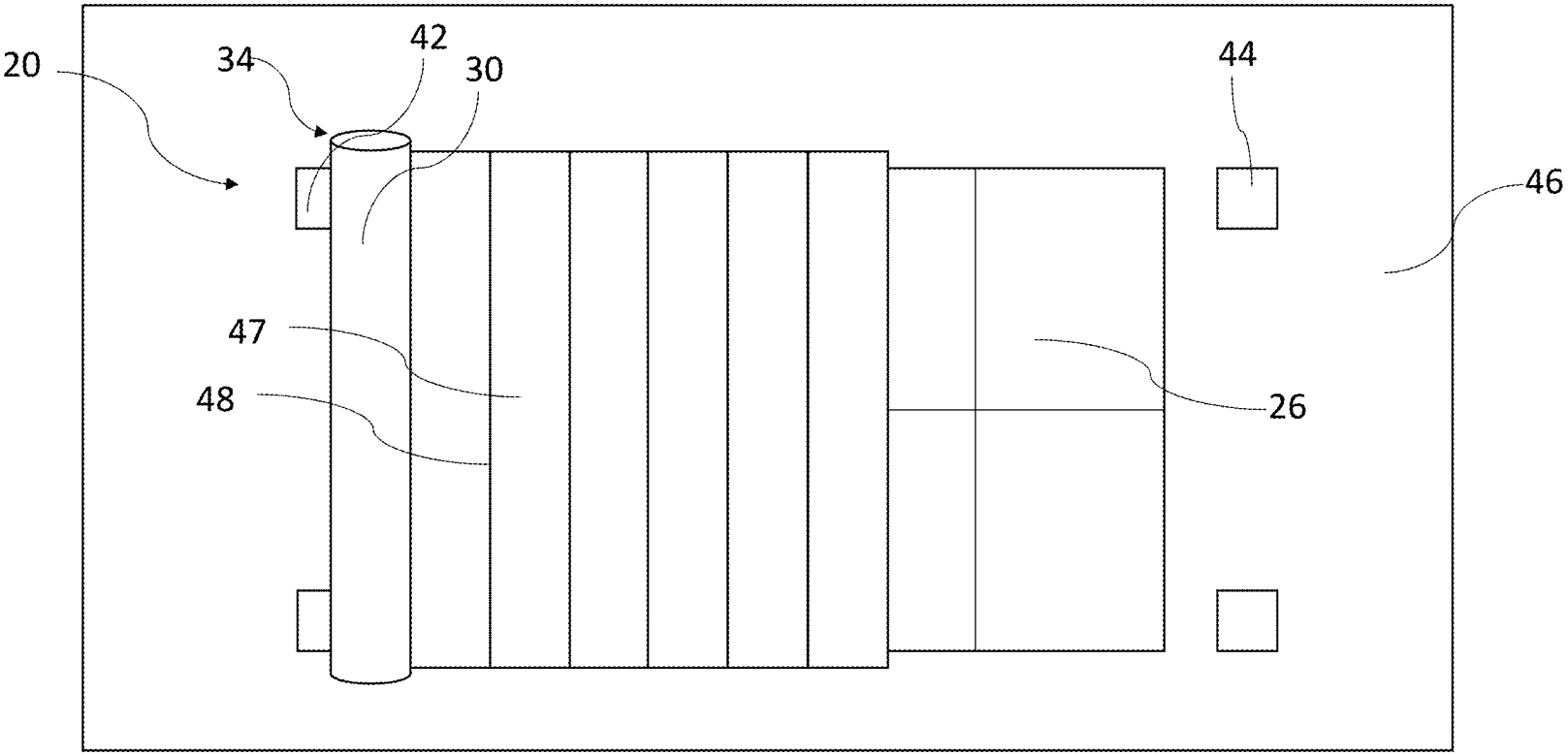
FIG. 3 is a schematic drawing of the lockdown barrier system of FIG. 2 showing the extendable sheet of anti-ballistic material after being moved from the retracted position to an intermediate position.
Figure 4:
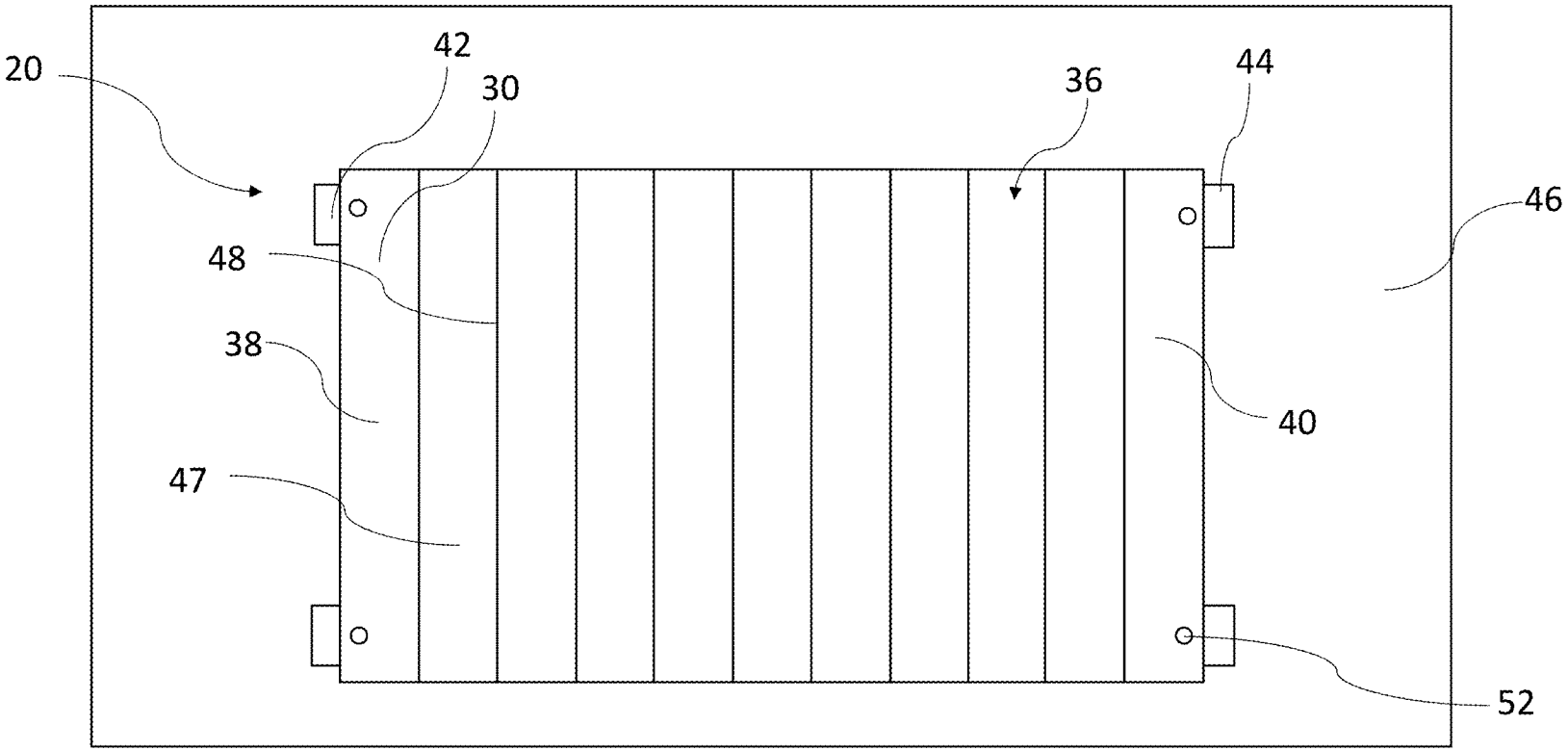
FIG. 4 is a schematic drawing of the lockdown barrier system of FIG. 3 showing the extendable sheet of anti-ballistic material after being moved from the intermediate position to the extended position.

Referring first to FIG. 1, a lockdown barrier system 20 is implemented in an interior room 22 of a building, such as a classroom in which individuals 24, who are all also potential operators of the lockdown barrier system 20, are located. The interior room 22 has both at least one window 26 and at least one door 28 that each include the lockdown barrier system 20. The interior room 22 may have any shape and any number of walls and the window 26 and the door 28 may have any suitable shape. The window 26 and door 28 are shown as being rectangular in shape, but the lockdown barrier system 20 is suitable for use with arched windows or doors, circular windows, or any other windows or doors having different polygonal shapes. Referring in addition to FIGS. 2-4, the lockdown barrier system 20 includes a sheet of shielding material 30 that is formed of a semi-rigid and anti-ballistic material, such that the sheet of shielding material 30 is "bullet-proof." The sheet of shielding material 30 is substantially flat and thin.

The sheet of shielding material 30 is moveable from a storage or retracted position 32 as shown in FIGS. 1 and 2, to an intermediate position 34 as shown in FIG. 3, and from the intermediate position 34 to an extended position 36 as shown in FIG. 4. The intermediate position 34 may correspond to any position of the sheet of shielding material 30 that is between the retracted position 32 and the extended position 36. When in the extended position 36, the sheet of shielding material 30 covers the entire surface of the window 26 or door 28 that faces into the interior room 22, such that none of the window 26 or door 28 is exposed to inside the interior room 22. The sheet of shielding material 30 may be moved manually or automatically from the retracted position 32 to the extended position 36.

As best shown in FIG. 4, the sheet of shielding material 30 has a first end 38 and a second end 40 opposite the first end 38. The first end 38 is secured to a first mount 42 when the sheet of shielding material is in the retracted position 32 and the extended position 36. A second mount 44 is arranged on an opposite side of the window 26 or door 28 relative to the first mount 42, at a location along a wall surface 46 that is spaced from the first mount 42. Any suitable number of mounts 42, 44 may be used and only one mount 42, 44 may be used. The mounts 42, 44 are fixed or secured to the wall 46. In exemplary embodiments, the mounts 42, 44 may be removably secured to the wall 46. The second end 40 of the sheet of shielding material 30 is freely moveable in a direction that is parallel to the wall surface 46 such that the second end 40 can be secured proximate to the first mount 42 and the first end 38 of the sheet of shielding material 30 when in the retracted position 32, and secured to the second mount 44 when in the extended position 36.

The second end 40 is releasably connectable to the second mount 44 for securing the second end 40 when in the extended position 36, such that the sheet of shielding material 30 is moveable between the extended position and the retracted position. When the lockdown barrier system 20 is implemented on the window 26, the first mount 42 and the second mount 44 are horizontally spaced, and the sheet of shielding material 30 is moveable in a horizontal direction. The mounts 42, 44 are horizontally spaced at a distance that is greater than a length of the window 26 to ensure that an entire length of the window 26 is covered when in the extended position. When the lockdown barrier system 20 is implemented on the door 28, the first mount 42 and the second mount 44 are vertically spaced, and the sheet of shielding material 30 is moveable in a vertical direction.

When the sheet of shielding material 30 is in the retracted position 32, the sheet of shielding material 30 may be wound or rolled as best shown in FIGS. 1 and 2, such that the sheet of shielding material 30 may be cylindrical in shape. In other exemplary embodiments, the sheet of shielding material 30 may be folded or have an accordion-like shape that enables the sheet of shielding material 30 to retract and expand. As the sheet of shielding material 30 is moved toward the extended position 36, the sheet of shielding material 30 is unwound or unrolled as best shown in FIG. 3. The sheet of shielding material 30 may have any suitable shape or arrangement. In an exemplary embodiment, the sheet of shielding material 30 is rectangular in shape and has a length that is longer than a width of the sheet. In other exemplary embodiments, the sheet of shielding material 30 may have curved corners or have an oval shape. The shape of the sheet of shielding material 30 may be dependent on the shape of the window or door to be covered by the sheet of shielding material 30.

The sheet of shielding material 30 may have any suitable length, width and thickness. The thickness of the sheet of shielding material 30 is much smaller than the width and length. One of the length and the width may be shorter relative to the other depending on the shape and size of the window or door to be covered. The dimensions of the sheet of shielding material 30 will be dependent on the size of the window or door. In exemplary applications, the sheet of shielding material 30 may have a length that is between two and twenty feet and a width that is between two and 20 feet. The sheet of shielding material 30 may have a length or width that is greater than twenty feet. The thickness of the sheet of shielding material 30 may be up to several inches. The length of the sheet of shielding material 30 may be selected such that the sheet of shielding material 30 will be taut along the length of the window or door. When in the retracted position 32, the thickness of the rolled or folded sheet of shielding material 30 will be greater than the thickness of the extended sheet of shielding material 30 and the length of the rolled or folded sheet of shielding material 30 will be less than half of the entire length of the extended sheet of shielding material 30. The length of the rolled or folded sheet of shielding material 30 may be less a quarter of the entire length of the extended sheet of shielding material 30.

In exemplary applications in which a window to be covered is large, more than one sheet of shielding material 30 may be used and the sheets may be adjacent to each other. The sheet of shielding material 30 is continuous and includes a plurality of connected panels 47. The panels 47 may be symmetrical and rectangular. The panels 47 may have similar dimensions. The panels 47 may be aligned with each other one-by-one and adjoined via creases or hinges 48 that also enable the panels 47 to be folded relative to each other. In exemplary embodiments, the panels 47 may be slightly bendable to enable folding of the panels 47, or sections of the sheet of shielding material 30 between the panels 47 may stretch or be flexible to enable folding of the panels 47.

The sheet of shielding material 30 is formed of any suitable anti-ballistic material. In an exemplary embodiment, the panels 47 are formed of the anti-ballistic material such that when the sheet of shielding material 30 is in the extended position, a continuous sheet of anti-ballistic material extends across the window or door. The anti-ballistic material may also be light-weight and rigid. The weight of the sheet of shielding material 30 may depend on the size. For example, a smaller sheet of shielding material 30 may be between five and six pounds. In other exemplary embodiments, the sheet of shielding material 30 may have a weight that is between two and twenty pounds. The weight of the sheet of shielding material 30 may be selected based on the size of a child that will be moving the sheet of shielding material 30 between the retracted and extended position. For example, a light-weight sheet of shielding material 30 may be between five and ten pounds for a child having a weight between forty and one hundred pounds, such as in classrooms for younger children. In high schools and classrooms that have larger children, larger and heavier sheets of shielding material 30 may be used.

Examples of suitable materials include a synthetic fiber material, a high modulus polyethylene material, a polycarbonate material, or a carbon fiber composite material. In an exemplary embodiment, the material may be Kevlar® or a similar material. The material may be formed from multiple layers of fabric that is woven from an aramid fiber. Any suitable number of layers may be used. In exemplary embodiments, the material may be coated and/or the material may have an outer cover. For example, the material may be a multi-layer material having Kevlar® layers, flexible semi-stiff polycarbonate sheets, and foamed cross-linked polyethylene sheets. The layers may be stitched or bonded together. Providing flexible sheets along with the Kevlar® layers may be advantageous in enabling some flexibility of the sheet of shielding material 30 such that the sheet of shielding material 30 is able to be bent or folded to the retracted position during storage.

In other exemplary embodiments, the material may be a composite material that includes aluminum, steel, titanium, or other metal materials. Many other materials and alloyed materials may be suitable. Laminated sheets of special plastics, metal mesh materials, ceramics, and shear-thickening liquids may be suitable. Many other materials may be suitable. The panels 47 may be attached to the continuous sheet of shielding material 30 using any suitable method such as sewing, gluing, melting, bolting, or any other fastening method. The sheet of shielding material 30 may be formed of one material or a combination of materials. For example, edges of the sheet of shielding material 30 may be formed of a different material than the anti-ballistic material covering the window or door.

The first end 38 of the sheet of shielding material 30 may be secured to the first mount 42 which is also secured to the wall surface 46. In an exemplary embodiment, the first mount 42 may include two mounts or more than two mounts that are spaced from each other. The first mount 42 may include bolts, screws, brackets, an adhesive material, or any other suitable type of fixing device for fixing the first mount 42 to the wall surface 46. The first end 38 of the sheet of shielding material 30 may be secured to the first mount 42 using attaching straps, magnets, clasps, hooks, or any other suitable attachment device that is secured to the sheet of shielding material 30. Fixing devices formed of a strong metal material may be suitable. For example, at least one of the first mount 42 and the second mount 44 may be in the form of a screw eye that is screwed into the wall surface 46. At least one of the first end 38 of the sheet of shielding material 30 and the second end 40 of the sheet of shielding material 30 may include a screw hook or clasp that is secured to the sheet of shielding material 30 and engageable with the corresponding screw eye.

Alternatively, at least one of the first mount 42 and the second mount 44 may be in the form of a screw hook or clasp and at least one of the first end 38 of the sheet of shielding material 30 and the second end 40 of the sheet of shielding material 30 may include a screw eye 50, as shown in FIG. 1, or a cylindrical ring 52 formed in the sheet of shielding material 30, as shown in FIG. 4, that is engageable with the screw hook or clasp of the corresponding mount 42, 44. The screw eye 50 or cylindrical ring 52 of the second end 40 of the sheet of shielding material 30 is engageable with the second mount 44 when the sheet of shielding material 30 is in the extended position. In still other embodiments, the second end 40 of the sheet of shielding material 30 may include a snap fastening mechanism with interlocking discs, a magnet, or a strap for securement with a complementary attachment component at the second mount 44. Any sort of releasable fastener that enables the second end 40 of the sheet of shielding material 30 to be attached to the wall and released from being attached to the wall may be suitable. The fastener or attachment device that corresponds to the end of the sheet of shielding material 30 that is to be attached to a corresponding wall mount may be secured to the sheet of shielding material 30 using any suitable fastening means, such as sewing, gluing, melting, bolting, or any other fastening method that enables the fastener to be embedded in or securely attached to the sheet of shielding material 30.

The second end 40 of the sheet of shielding material 30 may be held in the retracted position 32 using any suitable restraint or holding mechanism. As shown in FIGS. 1 and 2, the restraint mechanism may include at least one belt or strap 54 that extends across a length of the sheet of shielding material 30 when the sheet of shielding material 30 is folded or rolled. More than one belt or strap 54 may be used and the belt or strap 54 used may be dependent on the size of the sheet of shielding material 30. The strap 54 may be fastened using a hook and loop type fastener, such as a VELCRO® Brand fastener, a belt clip type fastener, or a tie or cable. Other types of fasteners may be suitable such as snap fasteners or magnets. The strap 54 may be fixed to the wall surface 46 or the first mount 42. In exemplary embodiments, the strap 54 may be formed integrally with the sheet of shielding material 30.

Figure 5:
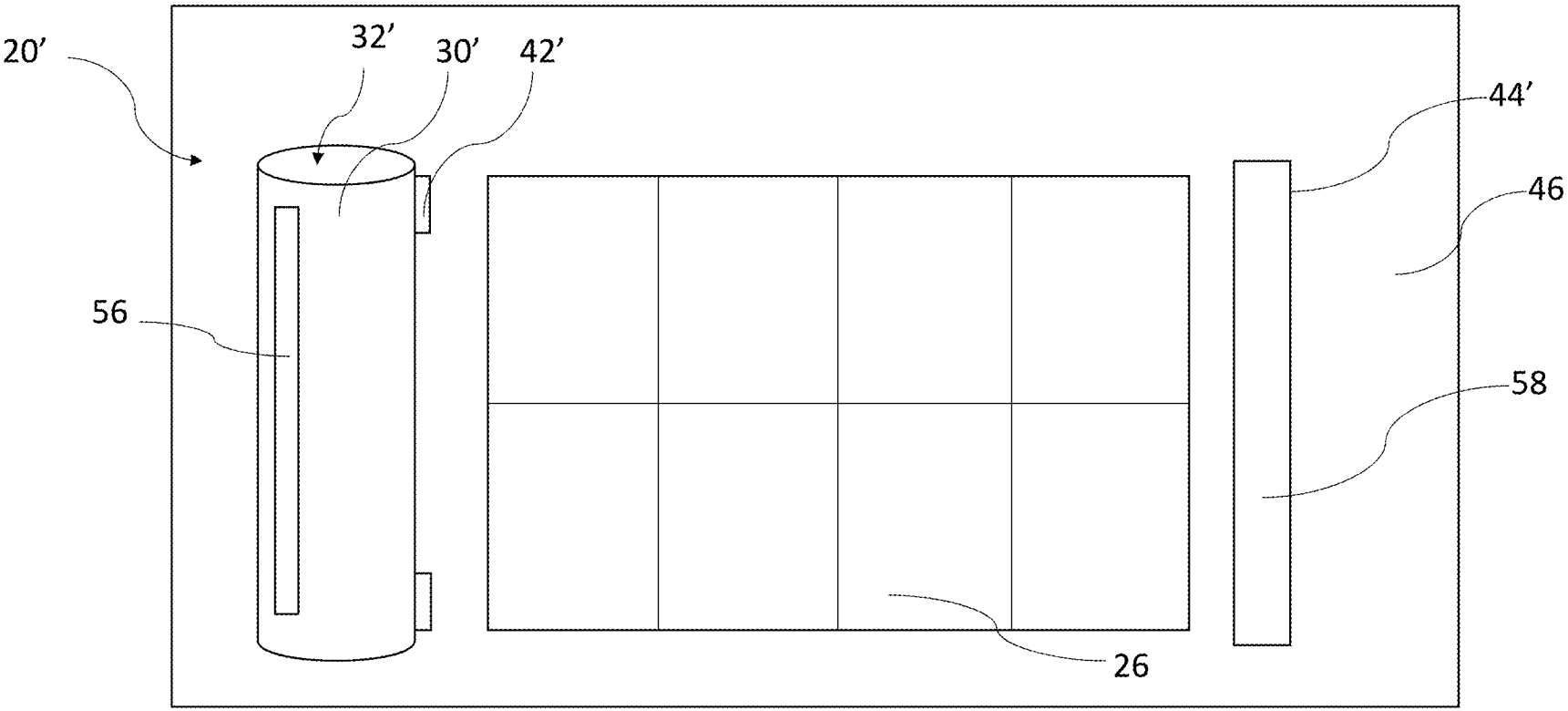
FIG. 5 is a schematic drawing of the lockdown barrier system of FIG. 1 in accordance with a second embodiment of the present invention.

Referring now to FIG. 5, a second embodiment of the lockdown barrier system 20' includes the sheet of shielding material 30' according to the first embodiment described above, but further includes a hook and loop fastener 56 that is formed as a strip that extends along the width of the sheet of shielding material 30'. The hook and loop fastener 56 may extend along the entire width of the sheet of shielding material 30' and may extend longer than a width of the window 26. The hook and loop fastener 56 is engageable with a complementary hook and loop fastener 58 formed as the second mount 44'. The complementary hook and loop fastener 58 is affixed to the wall surface 46 adjacent the window 26 (or door). When the sheet of shielding material 30' is in the extended position, the hook and loop fastener 56 is secured to the complementary hook and loop fastener 58. In alternative embodiments, the sheet of shielding material 30 may include a magnet strip or a strip of releasable adhesive material that engages a corresponding magnet strip or a strip of releasable adhesive material arranged at the second mount 44'. Another complementary hook and loop fastener 58 may be arranged proximate to the first mount 42' or the first end of the sheet of shielding material 30', or formed integrally at the first end of the sheet of shielding material 30', such that the second end of the sheet of shielding material 30' can be held in the retracted position 32'.

Figure 6:
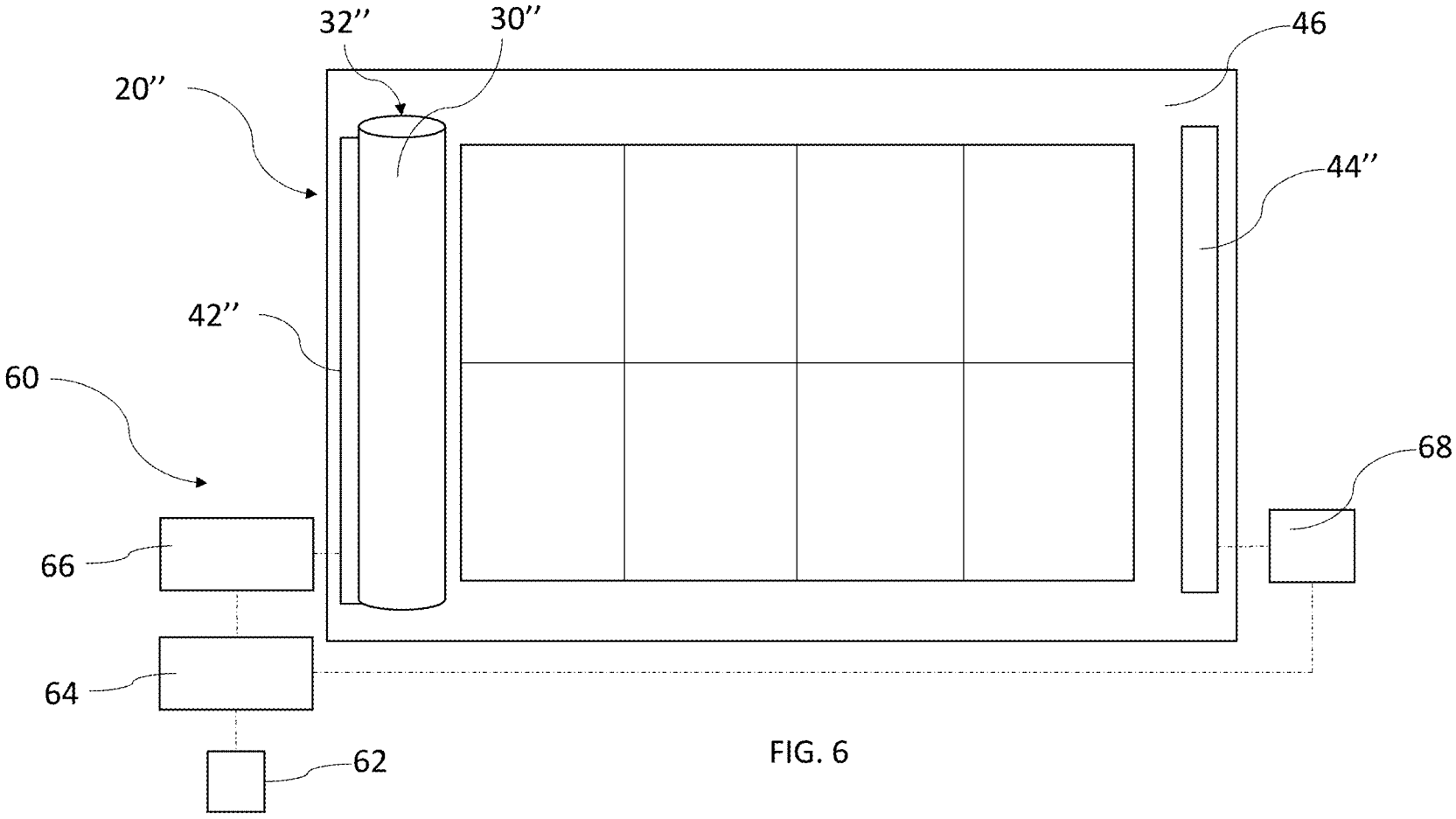
FIG. 6 is a schematic drawing of the lockdown barrier system of FIG. 1 in accordance with a third embodiment of the present invention.

Referring now to FIG. 6, a third embodiment of the lockdown barrier system 20" includes the sheet of shielding material 30" according to the first and second embodiments described above, but further includes an electronic control system 60. The lockdown barrier system 20, 20' may be manually operated, but alternatively, the lockdown barrier system 20" can be automatic or motor-driven using any suitable control and drive system. The electronic control system 60 includes a user input 62 that is in communication with a processor 64. The processor 64 is in communication with a drive mechanism 66 that is in communication with the first mount 42" and the second mount 44". The user input 62 may comprise any suitable user interface, such as for example a keypad, switch mechanism, touchscreen, or the like. The processor 64 may comprise any suitable electronic control mechanism, such as for example a central processing unit (CPU), microprocessor, control circuitry, and the like. The drive mechanism 66 may be any suitable electromechanical drive mechanism, such as for example an electric motor that drives a gearing system that interacts with first drive movement of the sheet of shielding material.

When the user input 62 is activated and received by the processor 64, the controller 66 communicates with the first mount 42" to release the sheet of shielding material 30" from the retracted position 32" and drive the second end of the sheet of shielding material 30" toward the second mount 44" and the extended position. The controller 66 is also in communication with the second mount 44" such that the second mount 44" is configured to receive and retain the second end of the sheet of shielding material 30" when in the extended position. At least one sensor 68 may also be provided to detect when the second end of the sheet of shielding material 30" is proximate the second mount 44" such that the securing mechanism can be activated for securing the second end of the sheet of shielding material 30" to the second mount 44". The sensor 68, for example, may be an optical sensor that optically detects the position of sheet of shielding materials, or a tactile sensor embedded in the second mount that is actuated when the second end of the sheet of shielding material reaches the second mount. When another user input 62 pertaining to retracting the sheet of shielding material 30" is received by the processor 64, the shielding material 30" is released by the second mount 44" and moves back toward the retracted position 32".

The lockdown barrier system 20', 20", 20'" is advantageous in that the system is easily implemented in a conventional interior room of a building and the system may be adjusted to accommodate different applications with varying windows and doors. Moving the sheet of shielding material to the extended position for covering the window may be easily achieved by a variety of operators, such as a child in a classroom. They system may be manually or electrically operated. The mounts may be arranged to accommodate any window or door size and a suitable type of mount may be selected and dependent on the building structure or wall size. The sheet of shielding material may also be sized up or down depending on the size of the window or door to be covered. The system is fixed, such that once the system is implemented in an interior room of a building, the system remains mounted in the room and ready for usage during an emergency situation. The shape of the sheet of shielding material enables the system to be compactly rolled or folded and mounted against the wall when the system is not activated.

A lockdown barrier system includes a first mount that is secured to a wall surface, a sheet of shielding material that is formed of an anti-ballistic material and moveable between a retracted position and an extended position, wherein the sheet of shielding material has a first end that is secured to the first mount and a second end opposite the first end that is freely moveable away from the first mount, and a second mount that is secured to the wall surface at a location that is spaced from the first mount. The second end of the sheet of shielding material is releasably connectable to the second mount, the second end being secured proximate to the first mount when in the retracted position, and the second end being secured to the second mount when in the extended position.

The sheet of shielding material may be wound or rolled when in the retracted position, and the sheet of shielding material may be unwound or unrolled during movement to the extended position.

The sheet of shielding material may have foldable panels.

The sheet of shielding material may be continuous and include a plurality of hinges between the foldable panels.

The sheet of shielding material may be rectangular in shape.

The second end of the sheet of shielding material may be moveable from the retracted position to the extended position in a direction that is parallel to the wall surface.

The first mount and the second mount may be horizontally spaced apart and the sheet of shielding material is moveable in a horizontal direction.

The first mount and the second mount may be vertically spaced apart and the sheet of shielding material is moveable in a vertical direction.

The sheet of shielding material may be held in the retracted position or in the extended position using straps, magnets, or clasps.

The second mount may include a screw eye.

The second end of the sheet of shielding material may include a screw hook, with the screw hook being hooked into the screw eye when the sheet of shielding material is in the extended position.

The second end of the sheet of shielding material may include a clasp, with the clasp being hooked into the screw eye when the sheet of shielding material is in the extended position.

The second mount may include a screw hook or a clasp.

The second end of the sheet of shielding material may include a cylindrical ring, with the cylindrical ring being hooked onto the screw hook or the clasp when the sheet of shielding material is in the extended position.

The lockdown barrier system may include at least one snap fastening mechanism whereby the second end of the sheet of shielding material is held in the retracted position proximate the first mount.

The at least one snap fastening mechanism may include first interlocking discs that are arranged proximate the first mount and at the second mount, and the second end of shielding material may include second interlocking discs that are engageable with the first interlocking discs.

The lockdown barrier system may include at least one hook and loop fastening mechanism whereby the second end of the sheet of shielding material is held in the retracted position proximate the first mount.

The at least one hook and loop fastening mechanism may include one of a hook and a loop that is arranged proximate the first mount and at the second mount, and the second end of shielding material includes the other of the hook and the loop that is engageable with the one of the hook and the loop.

The at least one hook and loop fastening mechanism may extend along an entire length or width of the second end of shielding material.

The lockdown barrier system may include an electronic control system and a drive motor that moves the sheet of shielding material between the extended position and the retracted position.

The anti-ballistic material may be semi-rigid.

The anti-ballistic material may be a synthetic fiber material, a high modulus polyethylene material, a polycarbonate material, or a carbon fiber composite material.

The anti-ballistic material may include a composite material that includes a metal material or a metal alloy material.

The anti-metal material may include steel or titanium.

A method of forming a lockdown barrier system includes providing a continuous sheet of shielding material that is formed of an anti-ballistic material, fixing a first end of the sheet of shielding material to a wall surface, fixing an attachment mechanism to the wall surface at a location that is spaced from the first end of the sheet of shielding material, forming a complementary attachment mechanism on a second end of the sheet of shielding material, wherein the second end of the sheet of shielding material is engageable with the attachment mechanism to be held in an extended position, and forming a retaining mechanism on the sheet of shielding material or proximate the first end of the sheet of shielding material, whereby the sheet of shielding material is held in a retracted position proximate the first end of the sheet of shielding material.

The method may include forming a hook and loop member along a length of the second end of the sheet of shielding material and forming a complementary hook and look member proximate the first end of the sheet of shielding material.

The method may include using straps, magnets, or clasps.

The method may include fixing the first end of the sheet of shielding material to the wall surface includes using bolts.

The method may include forming a plurality of symmetrical panels that are hinged together in a rectangular arrangement.

The method may include providing a control system and a drive motor that moves the sheet of shielding material between the retracted position and the extended position.

The method may include forming the continuous sheet of shielding material includes using a synthetic fiber material, a high modulus polyethylene material, a polycarbonate material, or a carbon fiber composite material.

Although the invention has been shown and described with respect to a certain embodiment or embodiments, it is obvious that equivalent alterations and modifications will occur to others skilled in the art upon the reading and understanding of this specification and the annexed drawings. In particular regard to the various functions performed by the above described elements (components, assemblies, devices, compositions, etc.), the terms (including a reference to a "means") used to describe such elements are intended to correspond, unless otherwise indicated, to any element which performs the specified function of the described element (i.e., that is functionally equivalent), even though not structurally equivalent to the disclosed structure which performs the function in the herein illustrated exemplary embodiment or embodiments of the invention. In addition, while a particular feature of the invention may have been described above with respect to only one or more of several illustrated embodiments, such feature may be combined with one or more other features of the other embodiments, as may be desired and advantageous for any given or particular application.

What is claimed is:

1. A lockdown barrier system comprising:

a first mount that is secured to a wall surface;

a sheet of shielding material formed of a semi-rigid and anti-ballistic material, the sheet of shielding material being moveable between a retracted position and an extended position, wherein the sheet of shielding material has a first end that is secured to the first mount and a second end opposite the first end that is freely moveable away from the first mount, wherein the sheet of shielding material is continuous and includes a plurality of panels; and a second mount that is secured to the wall surface at a location that is spaced from the first mount, wherein the second end of the sheet of shielding material is releasably connectable to the second mount, the second end being secured proximate to the first mount when in the retracted position, and the second end being secured to the second mount when in the extended position, wherein the sheet of shielding material is wound or rolled when in the retracted position, the sheet of shielding material being unwound or unrolled during movement to the extended position.

2. The lockdown barrier system according to claim 1, wherein the sheet of shielding material includes a plurality of hinges between each of the plurality of panels.

3. The lockdown barrier system according to claim 1, wherein the sheet of shielding material is rectangular in shape.

4. The lockdown barrier system according to claim 1, wherein the second end of the sheet of shielding material is moveable from the retracted position to the extended position in a direction that is parallel to the wall surface.

5. The lockdown barrier system according to claim 1, wherein the first mount and the second mount are horizontally spaced apart and the sheet of shielding material is moveable in a horizontal direction.

6. The lockdown barrier system according to claim 1, wherein the first mount and the second mount are vertically spaced apart and the sheet of shielding material is moveable in a vertical direction.

7. The lockdown barrier system according to claim 1, wherein the sheet of shielding material is held in the retracted position or in the extended position using straps, magnets, or clasps.

8. The lockdown barrier system according to claim 1, wherein the second mount includes a screw eye, and wherein the second end of the sheet of shielding material includes a screw hook or a clasp, the screw hook or the clap being hooked into the screw eye when the sheet of shielding material is in the extended position.

9. The lockdown barrier system according to claim 1, wherein the second mount includes a screw hook or a clasp.

10. The lockdown barrier system according to claim 9, wherein the second end of the sheet of shielding material includes a cylindrical ring, the cylindrical ring being hooked onto the screw hook or the clasp when the sheet of shielding material is in the extended position.

11. The lockdown barrier system according to claim 1, further comprising at least one snap fastening mechanism whereby the second end of the sheet of shielding material is held in the retracted position proximate the first mount.

12. The lockdown barrier system according to claim 11, wherein the at least one snap fastening mechanism includes first interlocking discs that are arranged proximate the first mount and at the second mount, and the second end of shielding material includes second interlocking discs that are engageable with the first interlocking discs.

13. The lockdown barrier system according to claim 1, further comprising at least one hook and loop fastening mechanism, whereby the second end of the sheet of shielding material is held in the retracted position proximate the first mount, wherein the at least one hook and loop fastening mechanism includes one of a hook and a loop that is arranged proximate the first mount and at the second mount, and the second end of shielding material includes the other of the hook and the loop that is engageable with the one of the hook and the loop.

14. The lockdown barrier system according to claim 13, wherein the at least one hook and loop fastening mechanism extends along an entire length or width of the second end of shielding material.

15. The lockdown barrier system according to claim 1, further comprising an electronic control system and a drive motor that moves the sheet of shielding material between the extended position and the retracted position.

16. The lockdown barrier system according to claim 1, wherein the anti-ballistic material is semi-rigid.

17. The lockdown barrier system according to claim 16, wherein the anti-ballistic material is a synthetic fiber material, a high modulus polyethylene material, a polycarbonate material, or a carbon fiber composite material.

18. The lockdown barrier system according to claim 1, wherein the anti-ballistic material includes a composite material that includes a metal material or a metal alloy material.

* * * * *